US005824932A

United States Patent [19]

Nakata

[11] Patent Number: 5,824,932

[45] Date of Patent: Oct. 20, 1998

[54] AUTOMATIC PERFORMING APPARATUS WITH SEQUENCE DATA MODIFICATION

[75] Inventor: Takuya Nakata, Shizuoka-ken, Japan

[73] Assignee: Yamaha Corporation, Hamamatsu, Japan

[21] Appl. No.: 937,054

[22] Filed: Sep. 24, 1997

Related U.S. Application Data

[63] Continuation of Ser. No. 542,381, Oct. 12, 1995, abandoned.

[30] Foreign Application Priority Data

Nov. 30, 1994 [JP] Japan ..... 6-297034

[51] Int. Cl.[6] ..... G10H 1/36

[52] U.S. Cl. ..... 84/609; 84/602; 84/610; 84/634

[58] Field of Search ..... 84/602, 604–607, 84/609–612, 634–636

[56] References Cited

U.S. PATENT DOCUMENTS 5,457,282 10/1995 Miyamoto et al. ..... 84/634

5,510,572 4/1996 Hayashi et al. ..... 84/609

FOREIGN PATENT DOCUMENTS 573036 3/1993 Japan .

*Primary Examiner*—William M. Shoop, Jr.
*Assistant Examiner*—Marlon T. Fletcher
*Attorney, Agent, or Firm*—Pillsbury Madison & Sutro LLP

[57] ABSTRACT

Character data representative of characters of song data and style data are written in header portions of the song data and the style data. When the user selects the song data and the style data, these character data are read out and compared with each other. By the comparison, a correction algorithm for correcting either the song data or the style data is determined. Either the song data or the style data is modified to match the other based upon the correction algorithm, and both data are simultaneously performed in an automatic performance.

33 Claims, 5 Drawing Sheets

AUTOMATIC PERFORMING APPARATUS WITH SEQUENCE DATA MODIFICATION

This is a continuation of application Ser. No. 08/542,381 filed Oct. 12, 1995, now abandoned.

BACKGROUND OF THE INVENTION

1. Field of the Invention

The present invention relates to an automatic performing apparatus that reads out both song data which is sequence data of a melody, and style data which is sequence data of an accompaniment, in parallel with each other to carry out an automatic performance.

2. Description of Related Art

In a typical conventional automatic performing apparatus, song data that is sequence data of a melody, and style data that is sequence data of an accompaniment are individually stored. One song data and one style data are selected and concurrently read out in parallel with each other so that a melody and an accompaniment representing the selected song data and the style data are performed at the same time to carry out an automatic performance. In this type of automatic performing apparatus, the atmosphere of the song can be changed by modifying the style data that is concurrently performed with the song data.

Among automatic performing apparatuses of the type described above, there is an apparatus in which song data is selected by the user, and style data is automatically selected in response to the song data, and an apparatus in which selection data is written in song data. There is also an apparatus in which style data is selected by the user in a similar manner as song data is selected.

However, when the musical atmosphere of the style data that is designated in the song data does not match the musical atmosphere of the song data, or when the atmosphere of the style date selected by the user does not match the atmosphere of the song data that is simultaneously performed with the selected style data, the melody of the music do not match the musical atmosphere of the accompaniment. As a result, the automatic performance becomes dull and unimpressive.

SUMMARY OF THE INVENTION

It is an object of the present invention to provide an automatic performing apparatus in which musical atmospheres of plural sequence data such as song data and style data are corrected to match each other for an automatic performance when the musical atmospheres of the plural sequence data do not match each other.

It is another object of the present invention to provide an automatic performing apparatus in which when musical atmospheres representative of performance contents of a plurality of sequence data are found to be unmatched, at least one of the performance contents of at least one of the sequence data is corrected to match the performance contents of the other sequence data. As a result, an automatic performance is provided with matched musical characters among the given sequence data.

In accordance with an embodiment of the present invention, an automatic performing apparatus reads out a plurality of sequence data in parallel for performing an automatic performance. Here, the plurality of sequence data includes, for example, melody data and accompaniment data. The automatic performing apparatus includes a character memory device that stores information representative of characters of a performance content of at least one of the plurality of sequence data, and a correction device that corrects performance contents of other sequence data based upon the information stored in the character memory device.

In accordance with another embodiment of the present invention, an automatic performing apparatus reads out a plurality of sequence data in parallel for performing an automatic performance. The automatic performing apparatus includes a character memory device that stores information representative of characters of performance contents of a plurality of sequence data, a comparator device that compares the characters of performance contents of the plurality of sequence data, and a correction device that corrects a performance content of at least one of the sequence data based upon a result of the comparison performed by the comparator device.

In accordance with still another embodiment of the present invention, an automatic performing apparatus reads out a plurality of sequence data in parallel for performing an automatic performance. The automatic performing apparatus includes a correction information memory device that stores correction information of one or a plurality of the plural sequence data, and a correction device that corrects performance contents of the one or the plurality of sequence data based upon the correction information stored in the correction information memory device.

In accordance with a further embodiment of the present invention, in an automatic performing apparatus that reads out a plurality of sequence data in parallel for performing an automatic performance, information representative of performance contents of sequence data are read out concurrently with the sequence data.

In accordance with yet another embodiment of the present invention, in an automatic performing apparatus that reads out a plurality of sequence data in parallel with each other for performing an automatic performance, correction information of one or a plurality of the plural sequence data is read out concurrently with other sequence data other than the sequence data that is to be corrected based on the correction information.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

Preferred embodiments of the present invention will be described in connection with the drawing wherein.

DETAILED DESCRIPTION OF EMBODIMENTS

Figure 1:
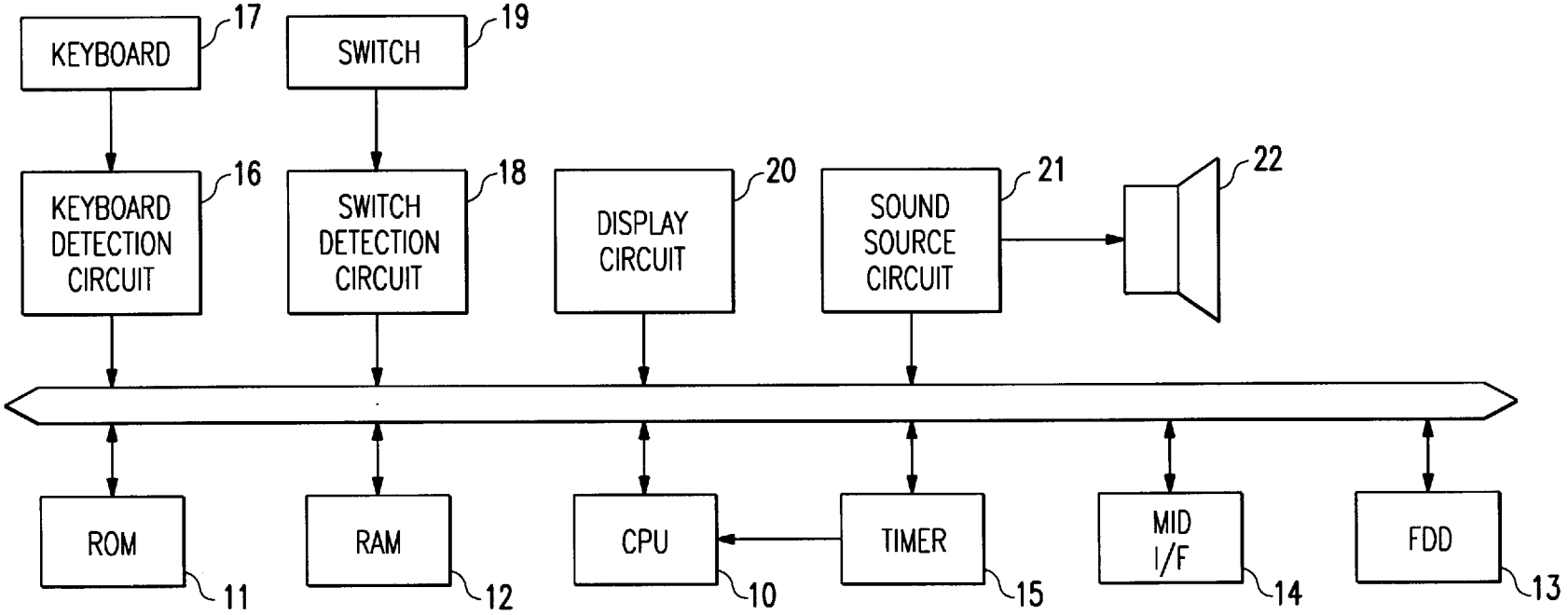
FIG. 1 shows a block diagram of an electronic musical instrument equipped with an automatic performing function in accordance with an embodiment of the present invention.
Figure 2A:
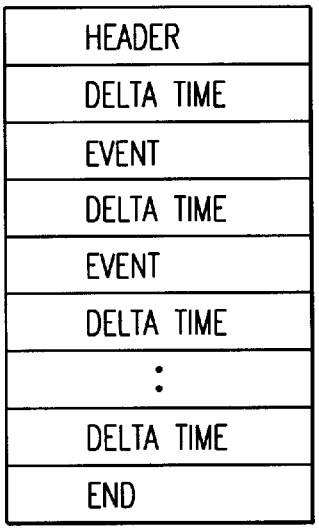
FIGS. 2(A) and 2(B) show data formats of song data and style data for the electronic musical instrument shown in FIG. 1.
Figure 2B:
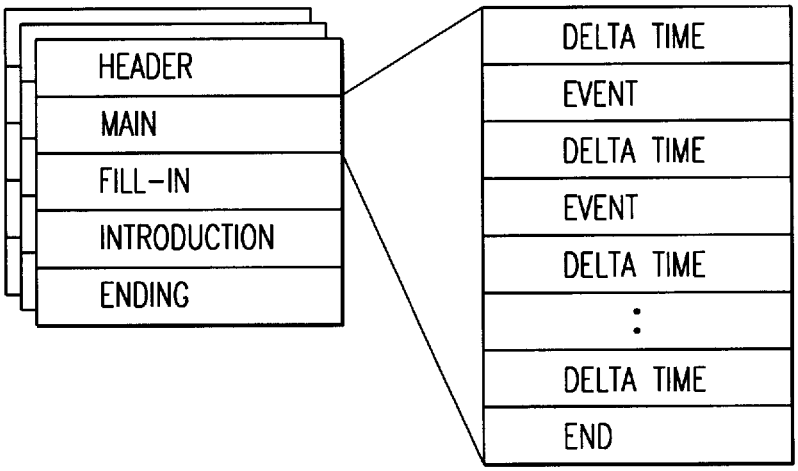

FIG. 1 shows a block diagram of an electronic musical instrument equipped with an automatic performing function in accordance with an embodiment of the present invention. The electronic musical instrument includes a keyboard 17 and is capable of generating musical sound by the performance of a performer. The electronic musical instrument is also capable of performing an automatic performance by concurrently reading out song data and style data in parallel with each other. It is noted that the song data is sequence data of a melody and the style data is sequence data of an accompaniment. The song data may be stored on a floppy disc that is inserted in a floppy disc drive 13. The floppy disc stores event data and delta time data representing a time interval between event data and an event as shown in FIG. 2(A). In alternative embodiments, the song data may be stored on other recording media, such as a CD, a ROM or the like. The style data is stored in a ROM (style memory) 11, and is formed by four sections including a main section, a fill-in section, an introduction section and an ending section, as shown in FIG. 2(B). Each section contains sequence data including patterns for several bars. The sequence data of the style data is formed in a similar manner as that of the song data.

Both song data and style data include headers. Character data representative of characters of the sequence data are written in the headers of both the song data and the style data. The character data includes, for example, genre, meter, beat of the data, or the like. The term "genre" is a name that represents a kind of music, for example, Rock, Pop, Jazz, Latin, Enka (Japanese soul), and the like. The term "meter" represents the number of beats within a bar. For example, triple time and quadruple time are popular. The term "beat" represents how many metrical pulses are marked within a bar. For music in quadruple time, four-beat, eight-beat and sixteen-beat are popular.

Since there are a plurality of song data and style data, the user selects one from each of the song data and the style data for automatic performance. When character data of the selected song data and the style data do not match each other in musical tone, an appropriate correction rule is selected. The correction rule may be automatically selected in a manner described later in a greater detail. After one of the song data and the style data has been corrected, an automatic performance is started.

As shown in FIG. 1, a control unit CPU 10 is connected through a bus to a ROM 11, a RAM 12, a floppy disc drive 13, a MIDI interface 14, a timer 15, a keyboard detection circuit 16, a switch detection circuit 18, a display circuit 20, and a sound source circuit 21. The ROM 11 includes a program memory that stores a control program for controlling the operation of the electronic musical instrument and a style data memory that stores the above mentioned style data. The RAM 12 has a song data buffer and a style data buffer that stores the selected song data and the selected style data, respectively, and also has a song header register and a style header register that store contents of the headers of the selected song data and the style data, respectively. The floppy disc drive 13 accommodates a floppy disc (not shown) that stores song data or the like. The MIDI interface 14 is connected to other MIDI equipment, and receives MIDI data for an automatic performance and MIDI data for designating the style data that is both sent from the connected MIDI equipment. The timer 15 is a circuit that provides an interruption to the CPU 10 at constant time intervals. The time interval between interruptions is determined by the song data and tempo data that is included in the style data.

A keyboard 17 is connected to the keyboard detection circuit 16. The keyboard 17 has keys for a range of about five octaves, key-on switches to detect ON/OFF states of the respective keys, and a sensor to detect initial touch strength and after touch strength of each key. The ON/OFF state provided by the key-on switch and values detected by the sensor are read by the CPU 10 through the keyboard detection circuit 16. In alternative embodiments, other musical instruments, such as for example, an electric guitar or the like may be used. The switch detection circuit 18 is connected to a group of various switches 19. The switch group 19 includes a song data selection switch for selecting song data, a style data selection switch for selecting style data, and a correction mode selection switch for selecting correction modes. For example, these modes are defined as MODE 1, which is a song data correction mode, and MODE 2, which is a style data correction mode. The ON/OFF states of the song data selection switch and the style data selection switch are detected by the switch detection circuit 18, and the detected result is read by the CPU 10. The display circuit 20 displays contents such as a currently selected tone name and the title of music that is being automatically performed. The sound source circuit 21 generates a sound signal based upon tone generation data that is inputted by the CPU 10.

FIG. 2(A) schematically shows a format of the song data which is stored in the floppy disc or the like. The song data includes a header portion formed at the leading end thereof. The header portion stores data such as the title of the song data, performance time, performance tempo and timbre of each channel, as well as character data that represents the characters of the song data. As described above, the character data is composed of data such as genre, meter and beat. The character data may also includes data indicating whether or not the song data is in triplet rhythm. The song data is determined to be in triplet rhythm if the performance content of the song data is structured mainly based on triplets. The term "genre" is a name that represents a kind of music, for example, Rock, Pop, Jazz, Latin, Enka (Japanese soul), and the like. The term "meter" represents the number of beats within a bar. For example, triple time and quadruple time are popular. The term "beat" represents how many metrical pulses are marked along a rhythm within a bar. For music pieces in quadruple time, four-beat, eight-beat and sixteen-beat are popular.

The sequence data, as described above, is formed by delta time data and event data that are alternately written. The delta time data is data that represents a time interval between an event data immediately before the delta time data and an event data immediately after the delta time data. The magnitude of the time interval is represented by the number of clock signals from the timer 15. The event data is composed of other performance event data including, for example, note event data (note-on, note-off), volume event data and pitch bend event data, chord designation event data and section designation event data. When a note event or another performance event is read out, event data thereof is transmitted to an operation unit such as the sound source circuit 21. The sound source circuit 21 controls the musical sound forming operation based upon inputted data. When chord designation event data is read out, chord designation data thereof is stored in a register ROOT, TYPE (not shown). The chord designation data is used for the determination of chord sound during automatic performance or used as a reference for note-pitch shift of base sounds. The section designation data is data for designating a section of the style data.

FIG. 2(B) shows a format of the style data. As described above, the style data is formed from data of four sections, that is, a main section, a fill-in section, an introduction section and an ending section. Character data representing characters of the style data, such as title, genre, meter and beat of the style data, are written in a header of the style data. Namely, the character data is composed of genre data, meter data and beat data, in a similar manner as that for the song data. Data of each section is composed of an accompaniment pattern for several bars. The accompaniment pattern is sequence data as shown on the right hand side of FIG. 2(B), which is composed of event data for generating rhythm sounds, base sounds and chord sounds. The base sounds and the chord sounds are all represented in a pitch to be generated when CM7 (C minor 7th chord) is designated. Therefore, when a sound is actually generated, the pitch is shifted based upon the designated ROOT, TYPE and then sent to the sound source circuit 21. The data of main section is style data that is used for an ordinary accompaniment during the performance of a music piece. The data of fill-in section is data that is inserted in the main section data at a caesura between adjacent phrases. The data of introduction section is style data that is performed at the beginning of a music piece. The data of ending section is style data that is performed at the ending of a music piece. Among this data, the data of main style is repeatedly performed, and therefore formed in a manner in which the leading portion and the end portion thereof can be readily connected with each other.

The style data memory in the ROM 11 is formed by a plurality of memory banks. Each memory bank stores a plurality of different style data. Therefore, by designating a memory bank number and a style number, one style data is designated. Also, as described above, each style data is formed by data of four sections. Therefore, by designating a section number, in addition to designating a memory bank number and a style number, one sequence data to be used for an automatic performance of an accompaniment is designated. In this embodiment, the memory bank number and the style number are designated by the user. Data for designating a section number (section designating data) is written in the song data as event data.

In embodiments of the present invention, one of the sound data and the style data is corrected in order to match the characters of the other according to a correction rule. In accordance with an embodiment of the present invention, correction rules are comprised of conditional nodes and correction algorithms. The conditional node represents a result of a comparison between character data of the sound data and the style data. The correction algorithm represents a content about what correction is made according to the result of comparison.

For example, when a conditional node is "reference data [which is sequence data that is not corrected] relates to music in triplet rhythm, and data to be corrected [which is sequence data that is to be corrected] is in non-triplet rhythm", a correction algorithm may be "the data to be corrected is modified to provide a hopping impression".

The "hopping impression" may be realized by, for example, ① a process in which the velocity of each beat is increased, and is decreased at other timings; ② a process in which the velocity is increased at each beat and decreased at other timings, and a sound of a designated beat is delayed; ③ a process in which the velocity is compressed or expanded about a specified center velocity; and ④ a process in which specified beats are delayed.

Other correction rules may include, for example, the following sets of conditional nodes and correction algorithms. 1) When a conditional node is given as "reference data represents music in non-triplet rhythm, and data to be corrected is in triplet rhythm", a correction algorithm may be defined by "the data to be corrected is quantized". 2) When a conditional node is "reference data represents a music piece in quadruple time, and data to be corrected is in triple time", a correction algorithm may be defined by "the data to be corrected is changed to one in quadruple time". 3) When a conditional node is given as "reference data represents music in triple time, and data to be corrected is in quadruple time", a correction algorithm may be defined by "the data to be corrected is changed to one in triple time". 4) When a conditional node is given as "both relate to music in triplet rhythm", a correction algorithm may be defined by "no correction is made". 5) When a conditional node is "both relate to music in quadruple time, a correction algorithm may be defined by "no correction is made". 6) When a conditional node is given as "both are music in triple time", a correction algorithm may be defined by "no correction is made".

For example, in accordance with an embodiment of the present invention, sequence data in triple time is modified to one in quadruple time by an algorithm dictating that "the last one of the beats is repeated". In another embodiment, sequence data in quadruple time is changed to one in triple time by an algorithm in which "the fourth beat is omitted".

Other correction algorithms include, for example, "the gate time is lengthen", "the gate time is shorted", and the like.

Figure 3A:
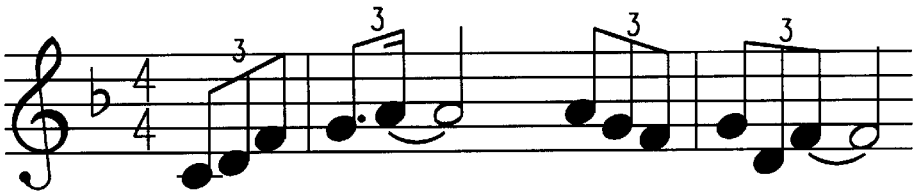
FIGS. 3(A) and 3(B) show sequence data in accordance with embodiments of the present invention.
Figure 3B:
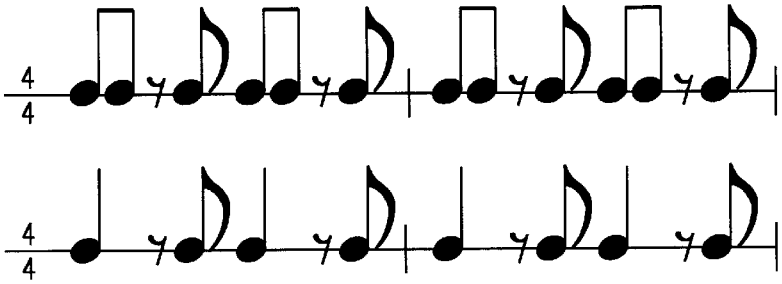
Figure 3C:
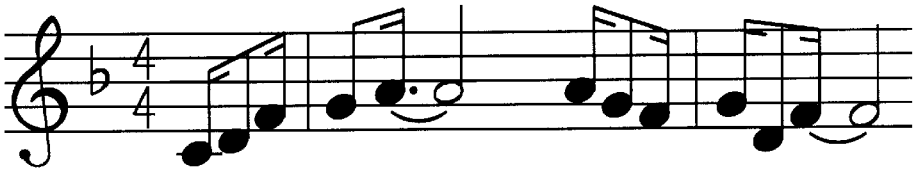
FIGS. 3(C) and 3(D) show corrected sequence data in accordance with embodiments of the present invention.
Figure 3D:
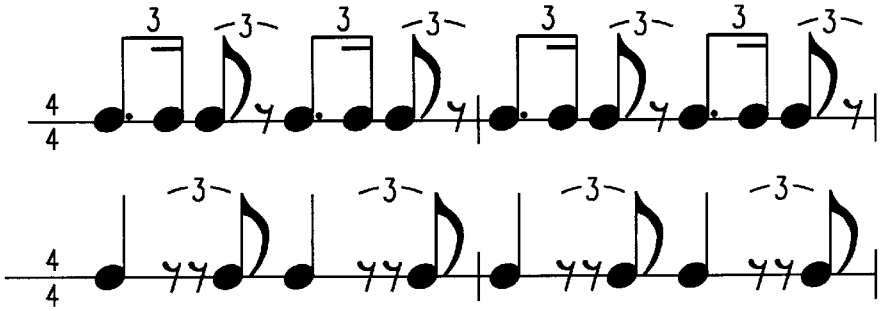

FIGS. 3(A)–(D) show embodiments in which the above described correction rules are applied. FIG. 3(A) shows a part of original song data, and FIG. 3(B) shows a part of original style data. FIG. 3(C) shows song data that has been modified to match the character of the style data, and FIG. 3(D) shows style data that has been modified to match the character of the song data. The song data shown in FIG. 3(A) represents a song in triplet rhythm and in quadruple time, and the style data shown in FIG. 3(B) is in eight-beat rhythm and in quadruple time. FIGS. 3(C) and 3(D) show embodiments in which the rhythm in data having different characters is modified. In FIG. 3(C), the triplet rhythm of eighth notes are changed into a rhythm composed of sixteenth note—eighth note—sixteenth note to match the eight-beat. In FIG. 3(D), the eight-beat is modified into twelve-beat to match the rhythm of the song data.

Figure 4:
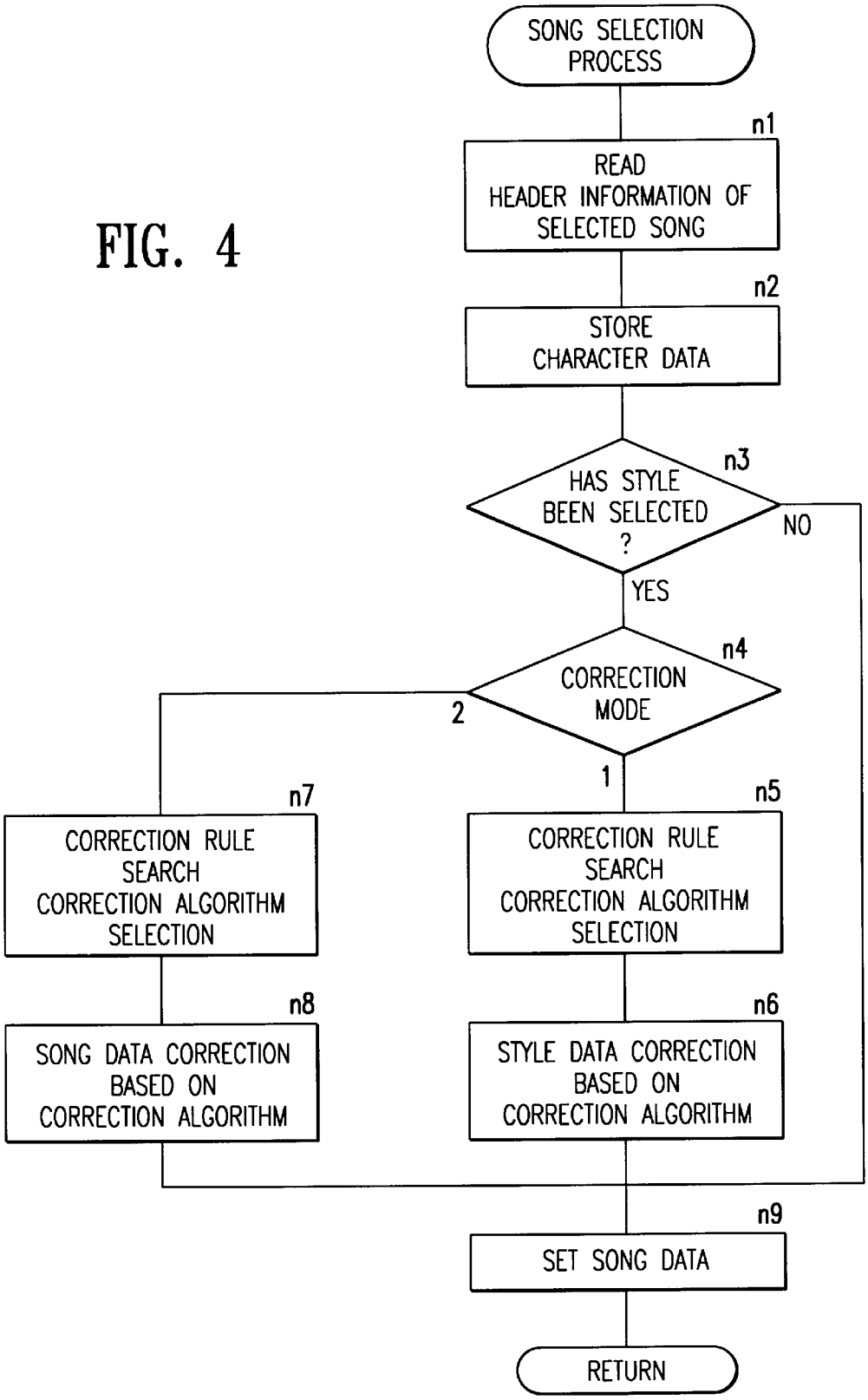
FIG. 4 shows a flow chart of an operation of an electronic musical instrument in accordance with an embodiment.
Figure 5:
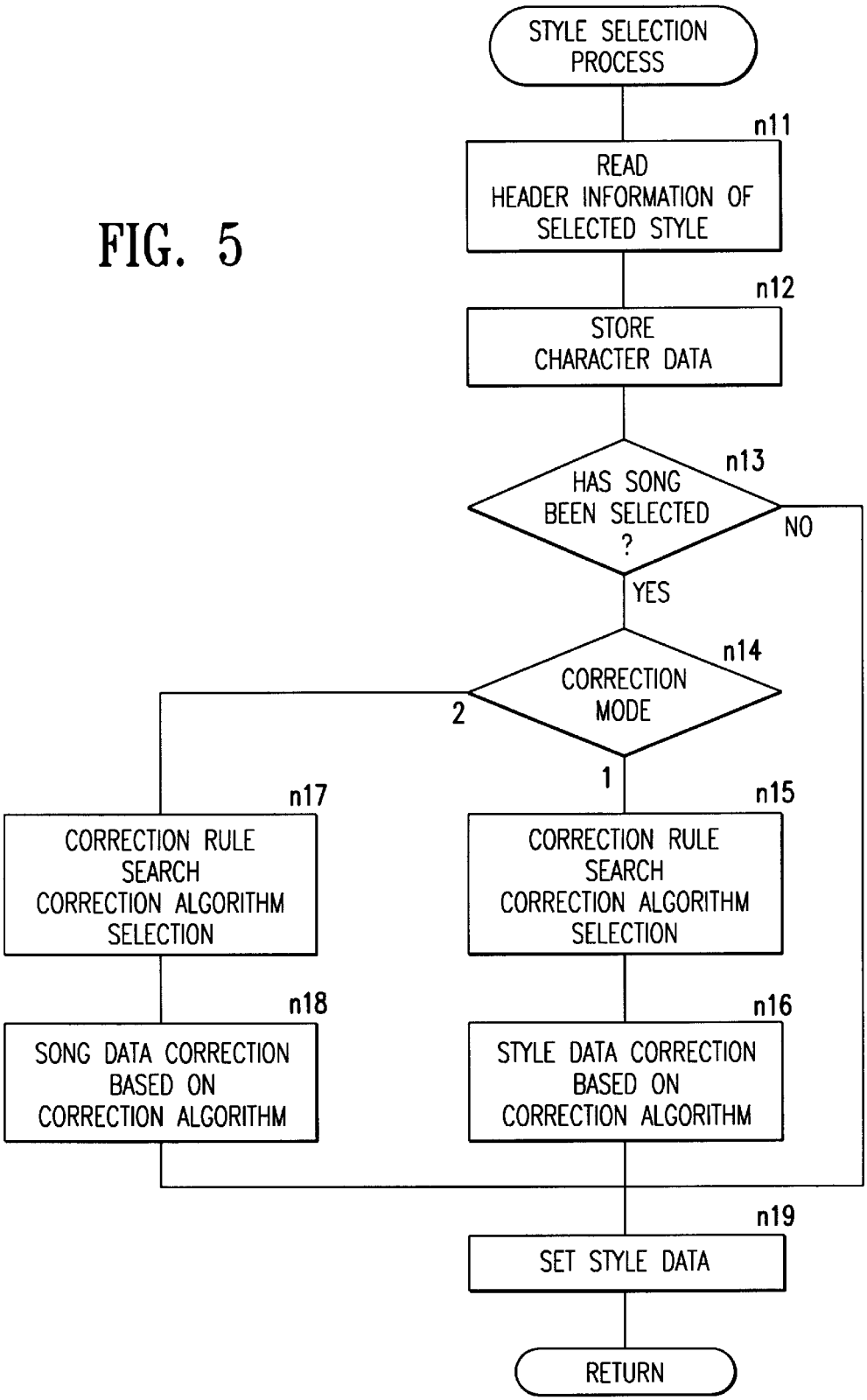
FIG. 5 shows a flow chart of an operation of an electronic musical instrument in accordance with an embodiment.

FIGS. 4 and 5 show flow charts of an operation of the electronic musical instrument. FIG. 4 shows an operation to be performed when the song data is selected by the user, and FIG. 5 shows an operation to be performed when the style data is selected by the user. The automatic performing operation and operations executed in response to the manipulation of the keyboard 17 are well known in the art and therefore are omitted.

Referring to FIG. 4, when song data is selected, a header of the selected song data is read out in step n1, and character data thereof is stored in a song header register in step n2. Next, a determination is made as to whether style data is selected in step n3. If style data has been selected, a correction mode is determined in step n4. The correction mode is a mode indicating which one of the song data and the style data is corrected to match the other. In Mode 1 which is a style data correction mode, steps n5 and n6 are executed. In Mode 2 which is a song data correction mode, steps n7 and n8 are executed. If style data has not been selected, the song data selected in this process is stored in the song data buffer of the RAM 12 in step n9 and the process returns to step n1.

In the style data correction mode, in step n5, a style data correction rule is selected based upon character data in the style data and character data in the song data. In step n6, the style data that has been stored in the style data buffer is corrected according to the algorithm of the selected correction rule. Thereafter, the song data is stored in the song data buffer of the RAM 12 in step n9. In the song data correction mode, in step n7, a song data correction rule is selected based upon character data in the song data and character data in the style data. In step n8, the song data selected in this operation is corrected according to the algorithm of the selected correction rule. Thereafter, the corrected song data is stored in the song data buffer of the RAM 12 in step n9.

Referring to FIG. 5, when style data is selected, a header of the selected style data is read out in step n11, and character data thereof is stored in the style header resister in step n12. Then, a determination is made as to whether song data has been selected in step n13. If song data has been selected, a correction mode is determined in step n14. In Mode 1 (style data correction mode), steps n15 and n16 are executed. In Mode 2 (song data correction mode), steps n17 and n18 are executed. If song data has not been selected, the style data selected in this operation is stored in the style data buffer of the RAM 12 in step n19, and the process returns to step n1.

In the style data correction mode, a style data correction rule is selected based upon character data of the style data and character data of the song data in step n15, and the style data selected in this operation is corrected according to the algorithm of the selected correction rule in step n16. Thereafter, the corrected style data is stored in the style data buffer of the RAM 12 in step n19. In the song data correction mode, in step n17, a song data correction rule is selected based upon character data of the song data and character data of the style data, and the song data that has been stored in the song data buffer is corrected according to the algorithm of the selected correction rule in step n18. Thereafter, the selected style data is stored in the style data buffer of the RAM 12 in step n19.

In the above described embodiment, one of the song data and the style data is selected and corrected. However, an arrangement may be made so that only one of the data is always corrected, or both of the data are corrected. Also, in the above described embodiment, the user can use a correction mode setting switch to select which one is corrected. However, data designating a mode may be written in the song data or the style data, or the CPU 10 may be arranged to make such a determination based upon a combination of the song data and the style data. Further, an arrangement may be made so that selection can be made as to whether or not correction is performed. In a further embodiment, an arrangement may be made in a manner that the apparatus automatically performs corrections, or another arrangement may be made in a manner that the user may be notified as to whether or not a correction is made so that the user can manually make correction.

In the above embodiment, a correction algorithm is selected based upon character data of the song data and the style data. However, correction algorithm designing data for designating a correction algorithm may be included in the song data or the style data so that a correction algorithm is selected based upon the correction algorithm designing data.

Also, in the above embodiment, the song data and the style data are independently selected by the user. However, style selection information (memory bank number designating data, style number designating data) may be written in the song data so that the style data is automatically selected and modified at the start of or during the automatic performance of the song data. In another embodiment, an automatic style data selection of the type described above may be combined with manual selection by the user so that data selected by both the selection methods are accepted during the automatic performance of the song data.

Moreover, correction algorithms are not limited to the embodiments described above. Furthermore, in the embodiments described above, the correction step is performed before automatic performance is started (when the song data and the style data are selected). However, the correction may be made in a preemptive-reading manner during automatic performance.

Also, song data is not limited to sequence data of a melody, but may be composed of a plurality of parts including bass and chord backing. In such a case, a correction algorithm may be applied to one part of the plural parts. Also, style data are not limited to rhythm, bass and chord.

In accordance with the present invention as described above, when a plurality of sequence data such as song data and style data are selected, and the performance characters of the sequence data do not match each other, one of the sequence data is corrected to match the other and then this data is simultaneously performed to carry out an automatic performance. As a result, even when a plurality of sequence data have different musical atmospheres, an automatic performance with matched musical atmospheres is performed.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An automatic performing apparatus carrying out an automatic performance based on song data representing a melody and style data representing an accompaniment provided in parallel, the automatic performing apparatus comprising:

a memory device that stores information representative of characters of performance contents of at least one of the song data and the style data; and a correction device that corrects a performance content of at least one of the song data and the style data based upon the information stored in the memory device so as to match the characteristics of the melody and the accompaniment to each other.

2. An automatic performing apparatus according to claim 1, wherein the correction device includes a device that has a plurality of correction algorithms, a selection device that selects one of the plurality of correction algorithms in response to the information stored in the memory device, and a modification device that applies the one of the plurality of correction algorithms selected by the selection device to the one of the song data and the style data to modify the performance contents.

3. An automatic performing apparatus according to claim 1, further comprising a device that selects one of the song data and the style data to be corrected.

4. An automatic performing apparatus according to claim 1, wherein the information representative of the performance content is read out concurrently with one of the song data and the style data corresponding to the information.

5. An automatic performing apparatus according to claim 1, wherein the impression characteristic is one of a genre, a beat and data indicating triplet rhythm regarding one of the song data and the style data.

6. An automatic performing apparatus according to claim 1, wherein the performance content to be corrected is one of a velocity of a beat and a timing of a beat.

7. An automatic performing apparatus according to claim 1, wherein the performance content to be corrected is a musical element of a note of the at least one of the song data and the style data to be corrected.

8. An automatic performing apparatus according to claim 1, wherein the performance content is corrected by the correction device by quantizing the performance content.

9. An automatic performing apparatus for reading out a plurality of selected sequence data in parallel and carrying out an automatic performance, the automatic performing apparatus comprising:

a memory device that stores information representative of characters of performance contents of the plurality of selected sequence data;

a comparator device that compares the impression-characteristics of the performance contents of the plurality of selected sequence data based on the information; and a correction device that corrects a performance content of at least one of the selected sequence data based upon a result of the comparison performed by the comparator device to match the characters of the performance contents of the plurality of sequence data to each other.

10. An automatic performing apparatus according to claim 9, wherein the correction device includes a device that has a plurality of correction algorithms, a selection device that selects one of the plurality of correction algorithms in response to the information stored in the memory device, and a modification device that applies the one of the plurality of correction algorithms selected by the selection device to the sequence data to modify the performance contents.

11. An automatic performing apparatus according to claim 9, further comprising a device that selects one of the plurality of sequence data to be corrected.

12. An automatic performing apparatus according to claim 9, wherein the impression-characteristic is one of a genre, a beat and data indicating triplet rhythm regarding at least one of the plurality of sequence data.

13. An automatic performing apparatus according to claim 9, wherein the performance content to be corrected is one of a velocity of a beat and a timing of a beat.

14. An automatic performing apparatus according to claim 9, wherein the performance content to be corrected is a musical element of a note of the at least one of the plurality of sequence data to be corrected.

15. An automatic performing apparatus according to claim 9, wherein the performance content is corrected by the correction device by quantizing the performance content.

16. An automatic performing apparatus for carrying out an automatic performance base on a plurality of selected sequence data provided in parallel, the automatic performing apparatus comprising:

a correction information memory device that stores a plurality of correction information; and a correction device that corrects performance contents of at least one of the plurality of selected sequence data based upon one of the plurality of correction information selected by comparing the information representing the characters, wherein the characteristics of the plurality of sequence data are matched to each other.

17. An automatic performing apparatus according to claim 16, wherein the correction device includes a device that has a plurality of correction algorithms as the plurality of correction information, a selection device that selects one of the plurality of correction algorithms in response to the the comparing result of the information representing the impression-characteristics, and modification device that applies the one of the plurality of correction algorithms selected by the selection device to the sequence data to modify the performance contents.

18. An automatic performing apparatus according to claim 16, further comprising a device that selects one of the plurality of sequence data to be corrected.

19. An automatic performing apparatus according to claim 16, wherein the correction information memory device stores correction information regarding a musical element of a note in the plurality of sequence data.

20. A method of performing an automatic performance according to claim 19, wherein the information representative of the performance contents are read out concurrently with one of the song data and the style data corresponding to the information.

21. An automatic performing apparatus comprising:

a first memory device that stores selected song sequence data, the selected song sequence data including first performance character data;

a second memory device that stores selected style sequence data, the selected style sequence data including second performance character data;

a mode selection device that selects one of a first mode to correct the song sequence data and a second mode to correct the style sequence data, a correction device that, when the first mode is selected, modifies the selected song sequence data based upon one of the first and second performance character data to provide modified data and, when the second mode is selected, modifies the style data based upon one of the first and second performance character data to provide modified data; and a sound generating device that concurrently reads out the modified data and at least one of the selected song sequence data and the selected style sequence data in parallel with each other to perform the automatic performance.

22. An automatic performing apparatus according to claim 21, further comprising a comparator device that compares the first performance character data and the second performance character data and provides a conditional output based on a result of a comparison, and a correction algorithm selecting device for selecting a correction algorithm in response to the conditional output, wherein the correction device modifies one of the song sequence data and the style sequence data based upon the correction algorithm in response to the selected mode.

23. A method for performing an automatic performance comprising the steps of:

storing information representative of impression-characteristics of performance contents of at least one of a plurality of song data representing a melody and style data representing an accompaniment;

correcting performance contents of at least one of the song data and the style data based upon the stored information so as to match the impression-characteristics of the melody and the accompaniment to each other; and performing an automatic performance based upon the song data and the style data provided in parallel.

24. A method of performing an automatic performance according to claim 23, wherein the correcting step includes the steps of storing a plurality of correction algorithms, selecting one of the plurality of correction algorithms in response to the stored information, and applying the selected one of the plurality of correction algorithms to the one of the song data and the style data to modify the performance contents.

25. A method of performing an automatic performance according to claim 23, further comprising the step of selecting one of song data and the style data to be corrected.

26. A method for performing an automatic performance comprising the steps of:

storing information representative of impression-characteristics of performance contents of a plurality of selected sequence data;

comparing the characteristics of the performance contents of the plurality of selected sequence data based on the information; and correcting a performance content of at least one of the selected sequence data based upon a result of the comparison to match the characteristics of the performance contents of the plurality of sequence data to each other.

27. A method of performing an automatic performance according to claim 26, wherein the correcting step includes the steps of storing a plurality of correction algorithms, selecting one of the plurality of correction algorithms in response to the stored information, and applying the selected one of the plurality of correction alghorithms to the sequence data to modify the performance contents.

28. A method of performing an automatic performance according to claim 26, further comprising the step of selecting one of the plurality of sequence data to be corrected.

29. A method for performing an automatic performance comprising the steps of:

providing information representing characters of a plurality of sequence data;

storing a plurality of correction information of one of the plurality of sequence data based upon impression-characteristics of the plurality of sequence data; and correcting performance contents of at least one of the plurality of sequence data based upon one of the stored plurality of correction information, wherein the characters of the plurality of sequence data are matched to each other.

30. A method for performing an automatic performance according to claim 29, wherein the correcting step includes the steps of storing a plurality of correction algorithms as the plurality of correction information, selecting one of the plurality of correction algorithms in response to the comparing result of the information representing the characteristics, and applying the selected one of the plurality of correction algorithms to the sequence data to modify the performance contents.

31. A method for performing an automatic performance according to claim 29, further comprising the step of selecting one of the plurality of sequence data to be corrected.

32. A method for performing an automatic performance comprising the steps of:

storing selected song sequence data, the selected song sequence data including first performance character data;

storing selected style sequence data, the selected style sequence data including second performance character data;

selecting one of a first mode to correct the song sequence data and a second mode to correct the style sequence data;

modifying the selected song sequence data based upon one of the first and second performance character data when the first mode is selected to provide modified data, and the selected style sequence data based upon one of the first and second character performance data when the second mode is selected to provide modified data; and concurrently reading out the modified data and at least one of the selected song sequence data and the selected style sequence data in parallel with each other to perform the automatic performance.

33. A method according to claim 32, further comprising the steps of comparing the first performance character data and the second performance character data to provide a conditional output based on a result of a comparison, and selecting a correction algorithm in response to the conditional output, wherein one of the song sequence data and the style sequence data is modified based upon the correction algorithm in response to the selected mode.

* * * * *